US006742930B2

(12) United States Patent
Matias

(10) Patent No.: US 6,742,930 B2
(45) Date of Patent: Jun. 1, 2004

(54) FLEXIBLE CONTAINER FOR LIQUIDS

(76) Inventor: Carlos J. D. Matias, Rua Moutinho da Silveika, 27 - 5C, Lisbon (PT)

( * ) Notice: Subject to any disclaimer, the term of this patent is extended or adjusted under 35 U.S.C. 154(b) by 0 days.

(21) Appl. No.: 10/135,001

(22) Filed: Apr. 29, 2002

(65) Prior Publication Data

US 2003/0056473 A1 Mar. 27, 2003

Related U.S. Application Data

(60) Provisional application No. 60/315,541, filed on Aug. 28, 2001, provisional application No. 60/315,542, filed on Aug. 28, 2001, and provisional application No. 60/315,540, filed on Aug. 28, 2001.

(51) Int. Cl.[7] ..... B65D 30/10

(52) U.S. Cl. ..... 383/105; 383/18; 383/24; 383/109; 383/119; 383/903

(58) Field of Search ..... 383/22, 24, 105, 383/109, 119, 18, 903

(56) References Cited

U.S. PATENT DOCUMENTS 2,696,235 A * 12/1954 Toffolon ..... 383/18
4,903,859 A * 2/1990 Derby et al. ..... 383/41
5,203,633 A * 4/1993 Derby ..... 383/17
5,468,528 A * 11/1995 Schnaars et al. ..... 428/35.7
5,538,155 A * 7/1996 Hoekstra ..... 220/495.01
5,618,255 A * 4/1997 Nickell et al. ..... 493/210
5,664,887 A * 9/1997 LaFleur ..... 383/119
6,244,443 B1 * 6/2001 Nickell et al. ..... 206/600
6,402,378 B1 * 6/2002 Shackleton ..... 383/119

FOREIGN PATENT DOCUMENTS

WO WO 092014660 A * 9/1992 ..... 383/119

* cited by examiner

*Primary Examiner*—Jes F. Pascua
(74) *Attorney, Agent, or Firm*—Michael C. Cesarano; Akernan Senterfitt

(57) ABSTRACT

A flexible container for liquids including an outer shell, an inner liner and an intermediate structure in which the intermediate liner is coupled to the outer shell to maintain a cross-sectional profile and the volume of the inner liner is greater than the enclosed volume of the intermediate structure. Liquids are loaded into a flexible container wherein the container is lifted by straps so that the container hangs freely, the container is filled with the liquid, the filling tube is sealed, the sealed tube is placed between the outer shell and stabilizing straps on the outside surface of the outer shell and the flexible container is then rested on a surface, trapping the filling tube between the outside surface and strap so that the container is securely sealed.

9 Claims, 6 Drawing Sheets

FLEXIBLE CONTAINER FOR LIQUIDS

This application claims the priority of pending application Nos. 60/315,541 filed on Aug. 28, 2001, 60/315,542 filed on Aug. 28, 2001, 60/315,540 filed on Aug. 28, 2001.

BACKGROUND OF THE INVENTION

The invention is generally directed to a flexible container for liquids which stands on its own without the need for a rigid structure and, in particular, to a flexible container for liquids suitable for use in transportation and storage of liquids.

The use of metallic drums for containing and transporting a variety of liquids has posed an environmental threat in various industries in recent years. Over time, the metallic drums have a tendency to wear, rust and leak and require specialized disposal handling procedures once their useful lives are completed. In addition, the energy required to produce the steel and manufacture the drums, including the hazardous primer and paint coatings used, as well as disposal and partial recycling, present a heavy environmental and physical cost to the planet.

In addition to the environmental concerns, drums represent significant dead weight in all transportation modes and additional cargo could be transported if the weight of the drums could be avoided. Generally, when transporting liquids the density of the liquid is such that the volumetric capacity of the trucks or other transporting carriers are not the limiting factor. Rather, it is the weight which limits the amount of cargo that can be transported.

Considerable improvement to the transportation of dry cargo was achieved with the introduction of super sacks or "big bags" for a multitude of uses and materials. With the new big bags millions of bags ranging from 25 kilogram to 70 kilogram capacity were replaced by the big bags and dry cargo could be moved more efficiently and economically, avoiding labor and speeding up cargo loading and unloading times.

In the past, flexible containers for liquids were generally attached to rigid frames to maintain a desired shape and, more importantly, to maintain the stability of the containers during handling and transportation. Generally, liquids flow within flexible containers and, as the container or the surface on which it rests tilts, the fluid tends to immediately respond to this change in base and flow with gravity to its lowest potential energy state. The effect of this is that generally a flexible container for a liquid will tend to move and shift as it is transported, which can be dangerous and difficult to control.

Accordingly, there is a need for an improved flexible container for liquids which allows safe transport and storage, reduces the tear or packaging weight of the container and improves recycling efficiency.

SUMMARY OF THE INVENTION

The invention is generally directed to a flexible container for liquids including an outer shell, an inner liner and an intermediate structure in which the intermediate liner is coupled to the outer shell to maintain a cross-sectional profile and the volume of the inner liner is greater than the enclosed volume of the intermediate structure.

Another object of the invention is to provide an improved process for loading liquids into a flexible container wherein the container is lifted by straps so that the container hangs freely, the container is filled with the liquid, the filling tube is sealed, the sealed tube is placed between the outer shell and stabilizing straps on the outside surface of the outer shell and the flexible container is then rested on a surface, trapping the filling tube between the outside surface and strap so that the container is securely sealed.

Another object of the invention is to provide an improved flexible container for liquids in which a stable structure is obtained which is resistant to tipping or unintended movement of the filled container.

Still another object of the invention is to provide an improved flexible container for liquids in which the container is resistant to puncturing due to use of an inner liner of larger volume than is necessary to fill the volume within the intermediate structure, so that when puncturing elements such as the forks from a forklift truck are pressed against the outer shell of the flexible container, the inner liner resists puncturing.

Yet a further object of the invention is to provide an improved flexible container in which interior or exterior straps are used on the outer shell of the flexible container which are slightly shorter in length than their connection points upon the outer shell so that improved structural rigidity of the filled container is provided.

Yet another object of the invention is to provide an improved flexible container for liquids in which an intermediate structure is connected to the centers of the sides of the outer shell in a fashion which provides a stable, generally rectangular tube which encloses and stabilizes the flexible inner liner.

Yet still another object of the invention is to provide an improved flexible container for liquids in which the outer shell includes horizontal and crossing straps which stabilize the shape of the flexible container, together with an intermediate structure secured to the inside of the outer shell.

Still yet a further object of the invention is to provide an improved flexible container for liquids including a filling tube which is sealed in the filled state between the supporting straps of the outer shell and the outer shell itself by the pressure exerted from within by the liquid in the flexible container.

Still other objects and advantages of the invention will, in part, be obvious and will, in part, be apparent from the specification.

The invention accordingly comprises the features of construction, combination of elements, arrangement of parts, combinations of steps and procedures, all of which will be exemplified in the constructions and processes hereinafter set forth and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
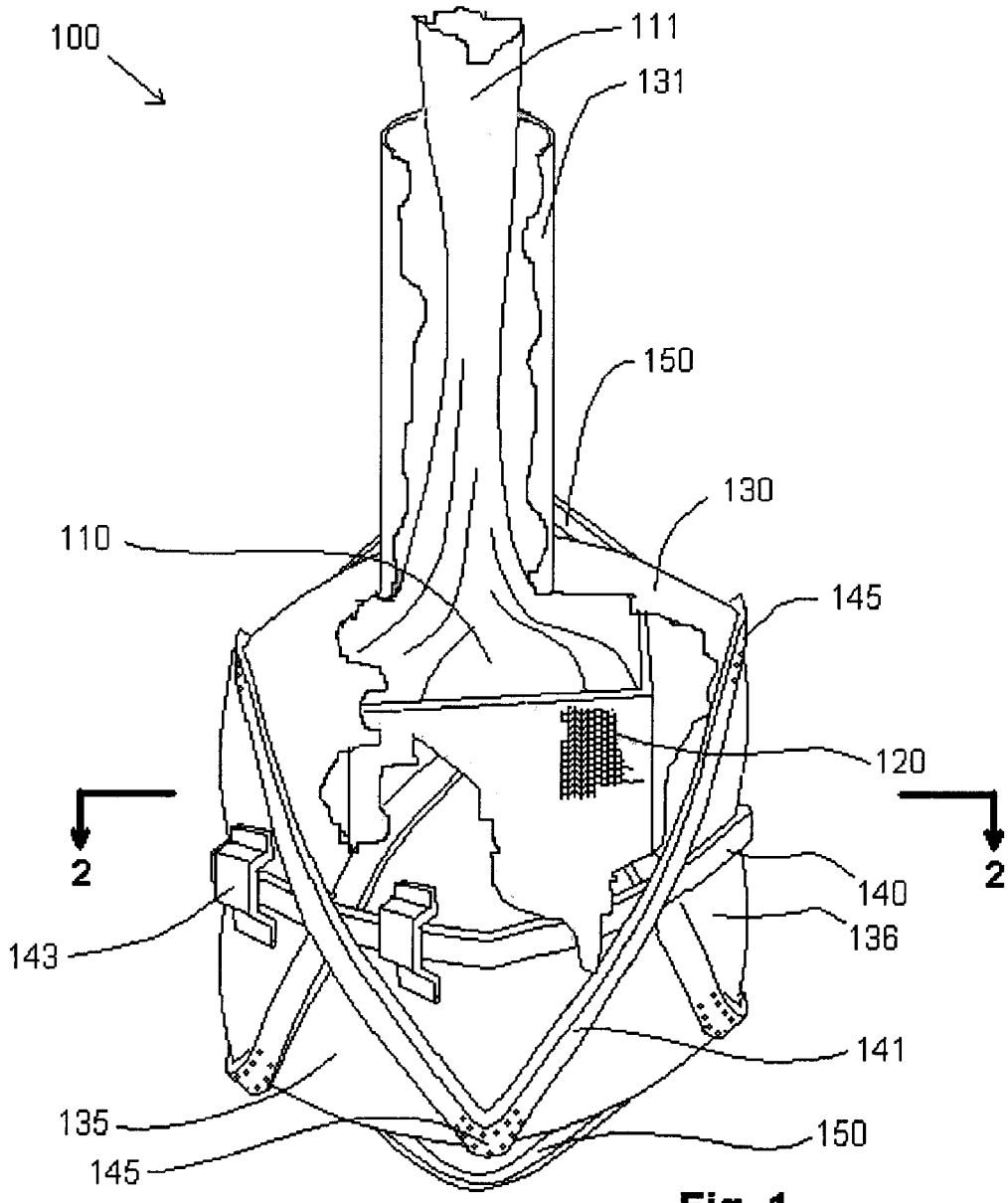
FIG. 1 is a partially cutaway perspective view of a flexible container for liquids constructed in accordance with a preferred embodiment of the invention.
Figure 2:
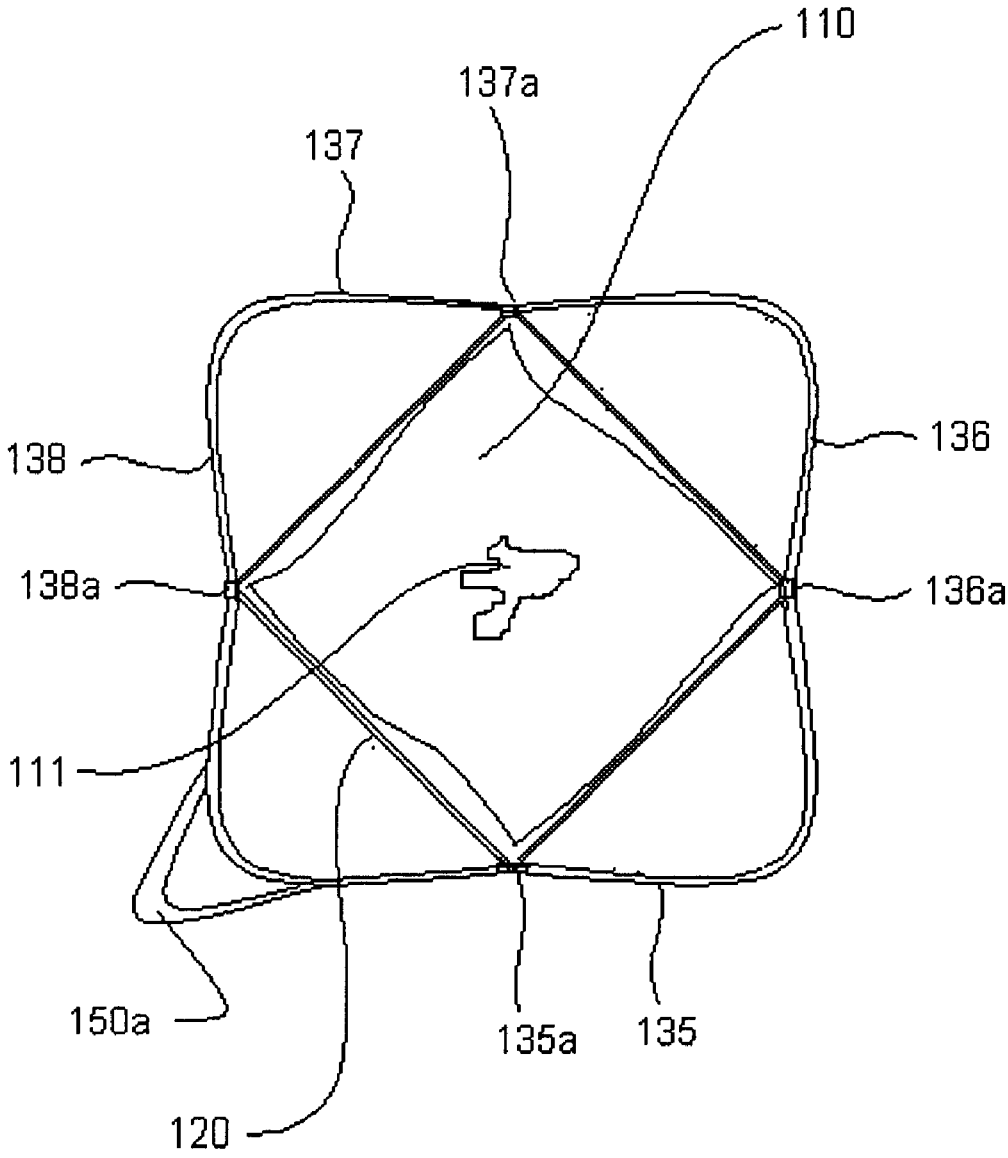
FIG. 2 is a cross-sectional view taken along line 2—2 of FIG. 1.
Figure 3:
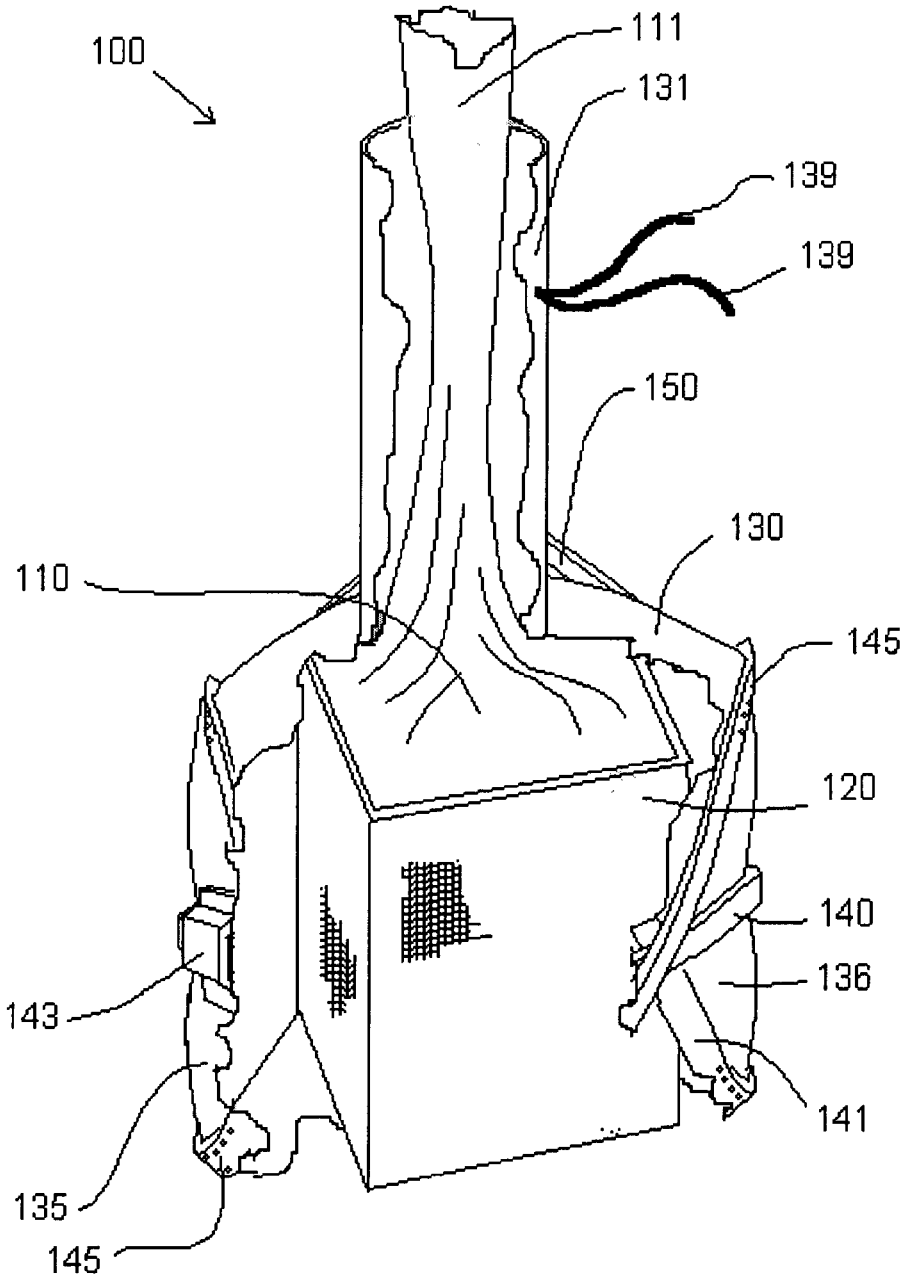
FIG. 3 is a partially cutaway perspective view of the flexible container of FIG. 1.
Figure 4:
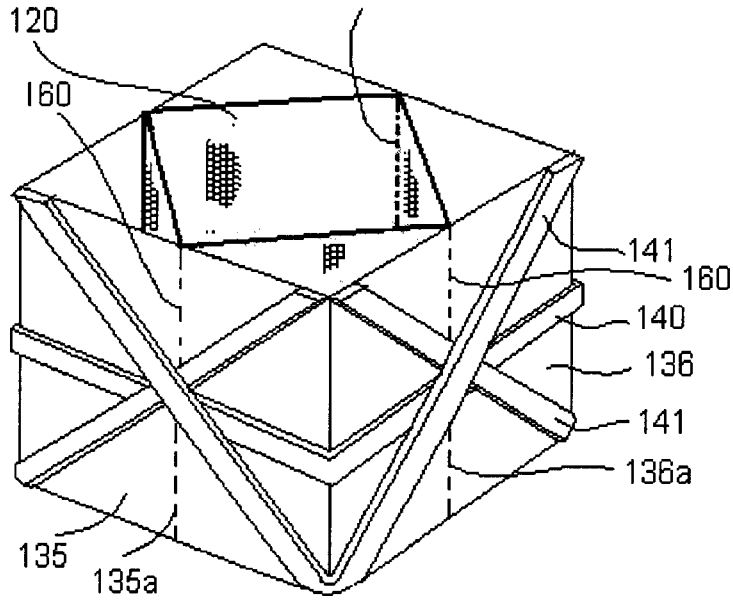
FIG. 4 is a perspective view of the outer shell and intermediate structure with the top surface of the outer shell and inner liner removed.
Figure 5:
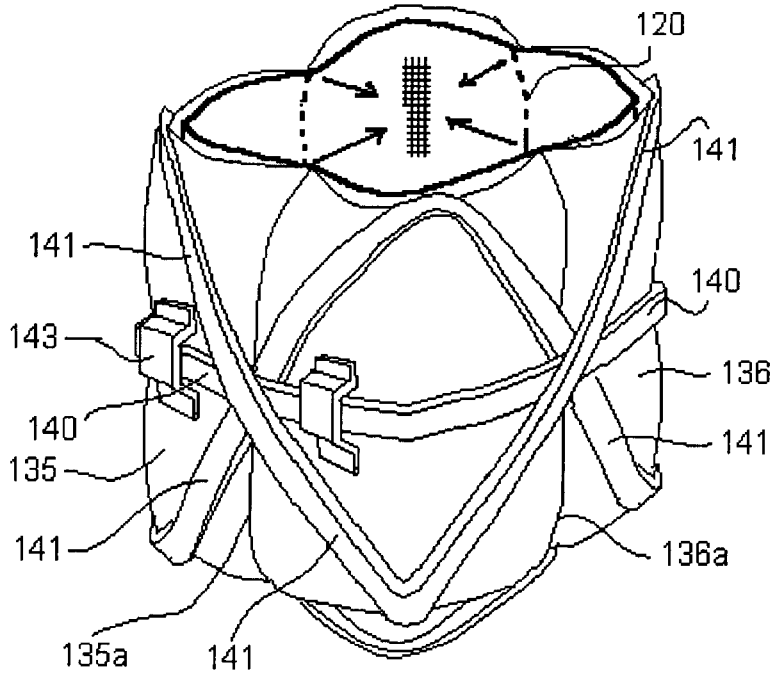
FIG. 5 is a perspective view similar to FIG. 4, without the top surface of the outer shell and the inner liner showing the way in which the intermediate structure and outer shell react when the container is filled with a liquid.

Reference is made to FIGS. 1 through 5 in which a flexible container for liquids, generally indicated as 100, is depicted. Flexible container 100 includes three distinct layers: an inner liner 110, an intermediate structure or interior reinforcement 120 and an outer shell 130. Each of these layers is generally flexible. Inner liner 110 fits within intermediate layer 120 but is not generally attached in any permanent fashion to the inside of intermediate layer 120. Inner liner 110 has a filling tube 111 extending generally out of the top of the inner liner, as seen in FIGS. 1 and 3. Intermediate layer 120 is formed generally as a tube, and is secured to outer shell 130 so that it appears to have four equal length sides. The corners of intermediate layer 120 are secured, generally by stitching, to outer shell 130. The side surfaces 135, 136, 137 and 138 of outer shell 130 are generally square in shape. The corners of intermediate layer 120 are generally sewn along the corners to the centers 135*a*, 136*a*, 137*a* and 138*a* of sides 135, 136, 137 and 138 of outer shell 130. This is best seen in FIGS. 2 and 4. The tube 120 may have any configuration and need not have any shape prior to attachment to outer shell 130. The attachment in four places tends to create the quadrilateral shape. When the container 100 is filled, the walls of the intermediate layer curve outward as shown in FIG. 5.

In addition, a horizontal strap or straps 140, held in place, preferably by belt loops 143, encircles the outer shell 130. Diagonal straps 141 extend to diagonally connect each of the opposite corners of side faces 135–138 of outer shell 130. These crisscrossed straps 141 may be formed as either individual straps which extend from one corner to another or may be longer straps which cover a number of different sides of outer shell 130 but are secured, generally, by either stitching or gluing at each corner at outer shell 130. The stitching 145 is shown at several of the corners in FIG. 1. Generally, both straps 140 and 141 are intended to have lengths which are substantially less than the corresponding length of the portion of outer shell 130 they are intended to support. For example, a diagonal strap 141 is intended to be somewhat shorter than the unstrapped distance between the corners of each of the sides 135–138. In this way, when the container 100 is filled with liquid, the liquid will tend to stretch straps 140 and 141 so that they will approach the unstretched size of the portions of outer shell 130 that they reinforce and provide structural stability to container 100 so that it doesn't easily tip or wobble.

Each of the inner liner 110, intermediate layer 120 and outer shell 130 are formed of relatively flexible materials. Different types of plastics, woven and non-woven materials may be utilized. The inner liner is either formed of a material which is non-reactive with and impervious to liquid to be contained therein or includes a protective coat or layer of material with these characteristics. In the current preferred embodiment, the inner liner is made of a double or triple layer of polyethylene, with each layer being approximately 0.05 millimeters thick. The inner tube is currently made of a woven polypropylene having a specific density of 110 grams per square meter and the outer shell is made of a woven polypropylene having a specific density of 240 grams per square meter. The reinforcing straps and the hanging straps are made of polypropylene, similar to those utilized in connection with big bags currently used for dry products and are generally two inches wide. The hanging straps are similarly formed of straps of polypropylene. The thickness and the strength of the polypropylene straps is adjusted based upon the anticipated volume of the liquid to be carried in the flexible container.

The flexible container can be formed with a variety of different volumes intended to be contained therein. Currently, preferred volumes are between about 800 and about 1,200 liters. Generally, commercial limitations based upon forklift capacity, truck sizes and pallet sizes will result in the flexible containers having a capacity of about 800 liters, equal to about four traditional drums. However, the system will generally work with greater or smaller capacity flexible containers. However, it is important that whatever size container is utilized that it be generally filled to its intended capacity. The effect of filling the flexible container 100 to its intended capacity is to cause inner layer 110 to exert outward pressure on intermediate layer 120 causing it to move from the position shown in FIG. 4 to that shown in FIG. 5, where the intermediate layer stretches between the connection points 160 at the center of sides 135–138, so as to fill in the open corners, although not necessarily filling the entire volume. It is also important that inner liner 110, not shown in FIGS. 4 and 5 for purposes of showing the way in which the other two layers move, has a capacity greater than the volume shown contained by intermediate layer 120 in FIG. 5. This additional capacity allows inner liner 110 to maintain its structural integrity even if there is a piercing pressure applied directly to the flexible container 100, such as by the forks of a forklift truck. The additional surface area and volume of inner liner 110 allows the liner to conform to the intruding member, such as the forklift's forks, rather than maintaining their position and being pierced by the pressure acting on the surface of inner liner 110. Similarly, to the extent that there are wrinkles or kinks in the inner liner which are maintained during the filling process, this does not affect the strength or flexibility of the flexible container.

As shown in FIGS. 1 and 3, there is a flexible filling tube 111 which forms a portion of the top surface of inner liner 110. Generally, filling tube 111 is a generally round cross-sectional tube of convenient length which may be attached to the filling mechanism (not shown). To some extent, filling tube 111 is protected by a sheath 131, which is a portion of the top surface of outer shell 130. Outer sheath 131 also may include tying straps 139, which can be used to seal the opening of filling tube 111. Generally, the straps are secured in one location and then wrapped around and tied to each other in a conventional fashion to provide a closure of the open end of tube 111. However, to provide an additional and reliable means of maintaining the tube 111 effectively sealed so that no leakage occurs, tied off sheath 131 with filling tube 111 is inserted between the outer surface of outer shell 130 and one or more of the diagonal straps 141 and/or horizontal 140. As detailed below, the flexible container 100 is filled in a hanging position, hanging from straps 150, which have the effect of maintaining straps 140, 141 in a position which does not exert any substantial positive force against the outer surface of outer shell 130. However, when the filled container 100 is placed on a flat surface, such as shipping pallet, the liquid in the inner liner exerts pressure against the restraining straps 140 and 141 as seen best in FIG. 5 and also trapping filling tube 111 and sheath 131 between them. This provides an effective, positive seal of the flexible container 100.

As a result of this construction, the flexible container when filled with liquids stands alone and does not require a rigid structure to be stable. Similarly, horizontal strap 140 is designed to be somewhat shorter in perimeter than the basic perimeter of outer shell 130. As shown in FIGS. 4 and 5, in the unfilled condition, container 100 has relatively orthogonal surfaces on the outer shell 130 and intermediate layer 120. However, when the container is filled with a liquid, as is depicted in FIG. 5 (even though inner liner 110 and the liquid contained therein are not shown for purposes of highlighting the relevant features) the shape of intermediate layer 120 is deformed outwardly between connection seams 120 so that the corner sections (shown in FIG. 4) are substantially filled and the outer shell 130 is similarly deformed so that a more curved appearance is achieved. This curved appearance is achieved through the pressures exerted by the liquid in inner liner 110 directly against intermediate layer 120 and indirectly to outer shell 130. Absent the horizontal straps 140 there would be a tendency for the liquids to be concentrated more heavily at the lower end of container 100, creating a pear shaped orientation. The horizontal straps 140 restricts the ability of the liquid to squeeze downward and outward in the container, instead constraining the liquid into a generally cubical shape. Similarly, the diagonal crossing straps 141 tend to retain the generally cubical shape of the outer shell 130 and prevent the liquid from moving within the container to unbalance the container. As a result of these straps the liquid is retained in a generally stable geometrical shape and position centered above the base of the flexible container in such a fashion that it is generally resistant to tipping and maintains itself in the vertical orientation without the need for any support. In fact, unlike most liquid containers, the tipping characteristics of the flexible container without a rigid frame or structure has an almost equivalent tipping resistance as do a rigid container such as barrels. Naturally, the container may be tipped over on its side if pushed beyond a certain angle with the horizontal. However, even in this orientation, the container would somewhat retain its general shape and could be returned to its vertical orientation. While the straps 140, 141 are shown on the outside of shell 130, they may also be present on the interior surface of shell 130 and serve the same function. In such a case, there will still be straps 150 to support the container 100 on the outside of shell 130 for loading.

In a current preferred embodiment of the invention, the outer shell 130 of flexible container 100 is made of woven polypropylene having a specific density of 240 g/m$^2$; the intermediate tube is made of woven polypropylene having a specific density of about 110 g/m$^2$ and the inner liner 110 is made of double or triple polyethylene where each layer is about 0.5 mm in thickness. Each of reinforcing straps 140 and 141 are, in a current preferred embodiment of the invention, made of 2 inch wide polypropylene straps similar to those used in the dry cargo big bags. The hanging straps 150, which are used to hang the container 100 from a forklift or other lifting device during the loading process and, again, if the bag is to be lifted, in a current preferred embodiment, that the centers of the sides of the outer shell 130. These are the same locations as the intermediate tube 120 is secured to the outer shell 130, along stitching seams 160.

Figure 6:
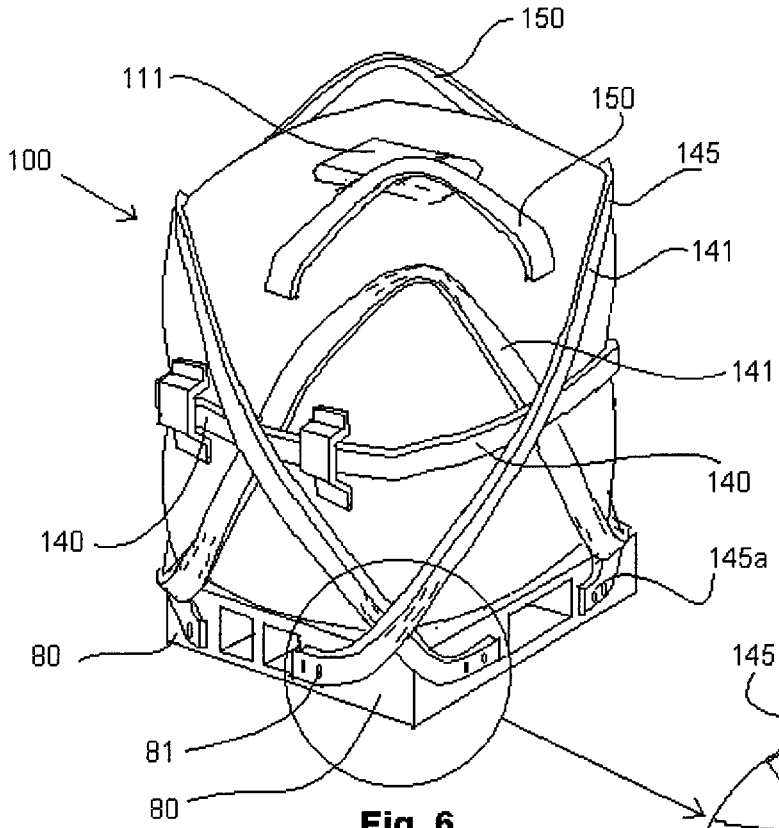
FIG. 6 is a prospective view of a flexible container for liquids constructed in accordance with a preferred embodiment of the invention wherein the flexible container is filled and sitting on a pallet.
Figure 7:
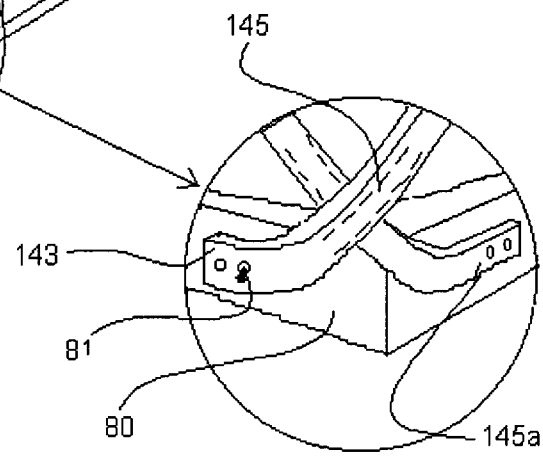
FIG. 7 is an enlarged perspective view of the circled portion of FIG. 6.

In a preferred embodiment of the invention, flexible container 100 has a capacity intended to hold 1,200 kgs. In a current preferred embodiment, the flexible container is intended to hold about 800 liters of liquid, such as orange juice, which has a weight of about 1,200 kgs. Generally, the containers can be made in different sizes depending upon the intended capacity of the shipping and storage facilities. For ease of handling and transportation, the flexible container 100 can be placed on a shipping pallet of standard size, which is commonly used for shipping, internal storage and within facility transportation purposes. The flexible container 100 constructed in accordance with a preferred embodiment of the invention sits on top of a pallet 200 in a generally vertical orientation as shown in FIG. 6. Pallet 200 supports the weight of flexible container 100 and allows for the container to be moved with a forklift truck and placed on a standard truck already on the pallet.

In a preferred embodiment, straps 141 extend beyond stitching 145 and include openings 143 which are adapted to receive hooks 81 so that container 100 is held in place. Hooks 81 are fixed in pallet 200.

Figure 8:
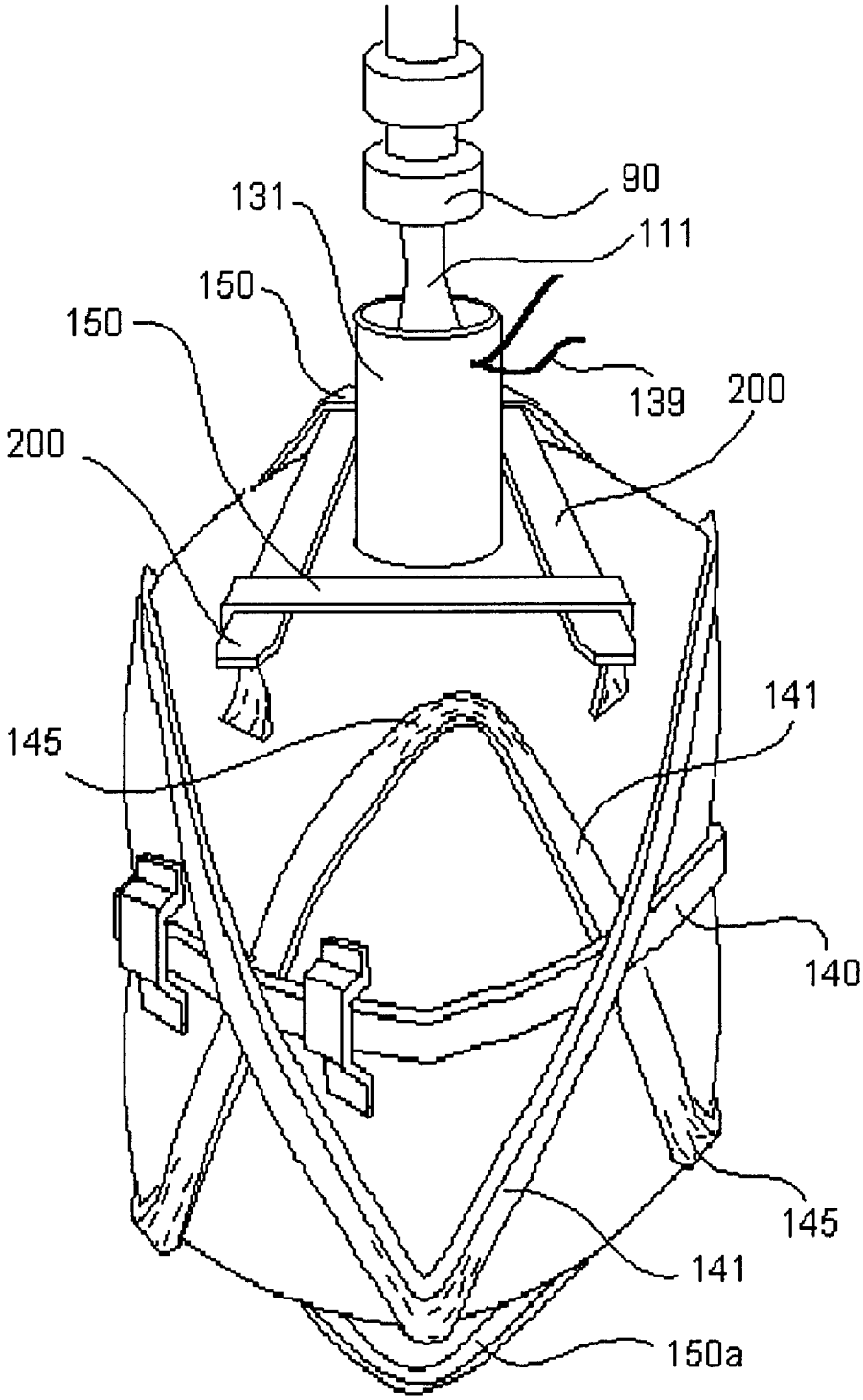
FIG. 8 is a perspective view of a flexible container for liquids constructed in accordance with a preferred embodiment of the invention which is being filled.

Reference is next made to FIG. 8 wherein a perspective view of a flexible container 100 constructed in accordance with a preferred embodiment of the invention is shown hanging from a forklift 200 by straps 150. Flexible container 100 has loading tube 111 with outer sheath 131 secured to the feed mechanism for filing container 100. Feeding tube 111 can be made in a variety of configurations so as to be adapted to seal with the feed mechanism 90. The container 100 can be supported either on a forklift truck or on a specially designed feeding jig intended to maintain the flexible container in the appropriate location. Generally, the flexible container in its empty state can be manipulated by a person without the need for powered equipment and placed in place. However, once loaded, it will be too heavy to be handled by an individual and will require a transportation device such as a forklift to move the filled container. As best seen in FIG. 8, when container 100 hangs during the filling process, it takes on a longer, narrower profile then when it is placed down on a surface.

Once the container is filled to its full extent the tube 111 is sealed off by use of a tie 139, valve or other constricting device which is wrapped around tube 111 and sheath 131 to prevent inadvertent flow of liquids out of inner liner 110. As shown in FIG. 3, straps 139 secured to sheath 131 can be merely wrapped around tube 111 and sheath 131 and then tied in place to serve this function. The ties can be formed either of the same material as the straps, nylon tie wraps such as are used in electrical circuitry placement or other metal, synthetic or natural materials. Thereafter, prior to the filled container 100 being placed on a surface and no longer suspended from straps 150, feeding tube 111 with enclosing sheath 131 is freed of any liquids and then folded over a side of container 100 and then inserted between straps 140, 141 and the adjoining outer wall of outer shell 130. Thereafter, when the filled container is placed on a surface and no longer hangs as shown in Fib. 6, the shifting pressure of the liquid inside flexible container 100 exerts a substantial outward force against the surface of outer shell 130, trapping tube 111 firmly between the straps 140, 141 and the outer surface 130 of flexible container 100 so that no liquid from within container 100 will escape through the feed tube.

The flexible container can be unloaded of its cargo by following a similar procedure as is utilized to load and fill the cargo. The container is lifted by straps 150, which causes the weight of the liquid in the container to shift downward thereby relieving the substantial squeezing pressure on the filling tube 111 between the outside surface of outer shell 130 and straps 140, 141. Thereafter, the filling tube can be freed and extended upwardly as in the filling position and as shown in FIG. 3. Thereafter, the end of the filling tube can be attached to the unloading mechanism and the straps 139 or other restricting member can be released and the unloading process commence. The unloading process can take different means. The unloading can either be gravity induced or done with a pumping mechanism. In alternate embodiments, additional tubes for loading and unloading are present in container 100. For example, an additional inlet can be placed on the bottom of container 100 to facilitate unloading.

The inner tube 120 is shown as being in a generally square profile. It is merely a tube and does not have end surfaces. In other configurations the inner tube may have a bottom wall to provide some further protection of the inner liner, although this is generally not necessary. In addition, the tube is shown as being generally quadrilateral due to four seams at the center of each of the four sides of the outer shell 130 which fix it into this configuration. This configuration promotes the maintenance of the cube-like shape. In other configurations the inner tube 120 can be secured to more or fewer spots on the outer shell 130 to provide varying configurations. In addition, the container can be formed with more or fewer of the straps. For example, the crisscross straps can be increased in number by crisscrossing between the corners of the outside shell and the horizontal straps 140 so that each face of the side of the container would have two crisscross sets of straps 141. This would provide additional structural rigidity and stability. Where the flexible container is larger in volume, it may be appropriate to add additional sets of horizontal straps 140 and additional diagonal straps 141 to further reinforce the structural rigidity of the side surfaces of the container. Other suitable materials may be utilized depending upon the specific needs and demands of the application. The inner liner may have special lining materials on its inner surface to assure that the surface is impervious to the material being contained, particularly where caustic or hazardous materials are involved.

Various different liquids having different densities and viscosities can be used in connection with the container in accordance with the invention. Relatively non-viscous liquids like water or various chemicals, more viscous liquids like orange juice or orange juice concentrate and very viscous liquids such as oils or greases work with the container.

Accordingly, an improved flexible container for liquids in which a stable, protective container for liquids suitable for shipping and storage, without the need for a rigid frame or structural element is provided. In addition, the process for loading of the flexible container with liquids is similarly provided.

It will thus be seen that the objects set forth above, among those made apparent in the proceeding description, are efficiently obtained and, since certain changes may be made in the above constructions and processes without departing from the spirit and scope of the invention, it is intended that all matter contained in the above description or shown in the accompanied drawings shall be interpreted as illustrative, and not in the limiting sense.

It will also be understood that the following claims are intended to cover all of the generic and specific features of the invention, herein described and all statements of the scope of the invention which, as a matter of language, might be said to fall therebetween.

What is claimed is:

1. A flexible container for liquids, comprising an outer shell; an inner liner; an intermediate structure, the intermediate structure coupled to the outer shall to form a cross-sectional profile, the intermediate structure having an enclosed volume; and the inner liner being situated substantially within the intermediate structure and having an enclosed volumetric capacity and a feed opening; said container having at least one strap held in place at two or more points on the outside of the outer shell to maintain the shape of the outer shell when filled, the length of the strap between at least two of the points being shorter than the distance between corresponding points along the surface of the outer shell.

2. The flexible container of claim 1, wherein the outer shell is a generally rectangular solid.

3. The flexible container of claim 2, wherein the straps include at least one diagonal strap extending across a face of the outer shell from a first connection point to a second connection point.

4. The flexible container of claim 2 in which the intermediate structure has a generally quadrilateral profile.

5. The flexible container of claim 4 wherein the generally quadrilateral profile of the intermediate structure has corners at connecting points joining the intermediate structure at four points to the inner surface of the outer shell.

6. The flexible container of claim 5 wherein the intermediate structure is joined to the outer shell by stitching the intermediate structure to the outer shell.

7. The flexible container of claim 1, wherein the straps include a horizontal strap extending around the sides of the outer shell.

8. A flexible container for liquids comprising an outer shell having a perimeter; an inner liner inside the outer shell; an intermediate structure, the intermediate structure being coupled to the outer shell to form a cross-sectional profile; the intermediate structure having an enclosed volume; and the inner liner having an enclosed volumetric capacity and a feed opening; at least one strap secured to the outside of the outer shell to maintain the shape of the outer shell when filled, including at least one horizontal strap encircling the perimeter of the outer shell and having a length less than the perimeter of the outer shell.

9. The flexible container for liquids, comprising an outer shell, the outer shell being a generally rectangular solid; an inner liner, inside the outer shell; an intermediate structure, the intermediate structure coupled to the outer shell to form a cross-sectional profile, the intermediate structure having an enclosed volume; and the inner liner having an enclosed volumetric capacity and a feed opening; at least one strap secured to the outside of the outer shell to maintain the shape of the outer shell when filled, including at least one diagonal strap extending across a face of the outer shell from a first connection point to a second connection point, wherein the length of the at least one diagonal strap is less than a distance on the outer shell between the first and second connection points of the diagonal strap.

* * * * *